US009937508B2

(12) United States Patent
Dau et al.

(10) Patent No.: US 9,937,508 B2
(45) Date of Patent: Apr. 10, 2018

(54) ELECTROSTATIC SPRAYING DEVICE AND METHOD FOR CONTROLLING ELECTROSTATIC SPRAYING DEVICE

(71) Applicant: SUMITOMO CHEMICAL COMPANY, LIMITED, Tokyo (JP)

(72) Inventors: Van Thanh Dau, Takarazuka (JP); Tibor Terebessy, Wallingford (GB)

(73) Assignee: SUMITOMO CHEMICAL COMPANY, LIMITED, Tokyo (JP)

( * ) Notice: Subject to any disclaimer, the term of this patent is extended or adjusted under 35 U.S.C. 154(b) by 92 days.

(21) Appl. No.: 14/776,155

(22) PCT Filed: Feb. 12, 2014

(86) PCT No.: PCT/JP2014/053204

§ 371 (c)(1),
(2) Date: Sep. 14, 2015

(87) PCT Pub. No.: WO2014/141798

PCT Pub. Date: Sep. 18, 2014

(65) Prior Publication Data

US 2016/0030957 A1 Feb. 4, 2016

(30) Foreign Application Priority Data

Mar. 15, 2013 (JP) ..... 2013-054035

(51) Int. Cl.

| | |
|---|---|
| ***B05B 15/00*** | (2018.01) |
| ***B05B 5/053*** | (2006.01) |
| ***B05B 5/025*** | (2006.01) |

(52) U.S. Cl.
CPC ..... *B05B 5/0533* (2013.01); *B05B 5/0255* (2013.01); *B05B 5/0535* (2013.01)

(58) Field of Classification Search
CPC .... B05B 5/0533; B05B 5/0535; B05B 5/0255
(Continued)

(56) References Cited

U.S. PATENT DOCUMENTS

| | | | |
|---|---|---|---|
| 4,157,162 | A | 6/1979 | Benedek et al. |
| 4,171,100 | A | 10/1979 | Benedek et al. |

(Continued)

FOREIGN PATENT DOCUMENTS

| | | | |
|---|---|---|---|
| CN | 85109673 | A | 6/1986 |
| EP | 1 894 634 | A1 | 3/2008 |

(Continued)

OTHER PUBLICATIONS

First Office Action issued in Chinese Patent Application No. 201480013108.2 dated Oct. 31, 2016.

(Continued)

*Primary Examiner* — Jason Boeckmann
(74) *Attorney, Agent, or Firm* — Foley & Lardner LLP

(57) ABSTRACT

An electrostatic atomizer (100) includes a guard electrode (4) between an opening (11) and an opening (12). The guard electrode (4) is different from a spray electrode (1) and a reference electrode (2). A voltage between the spray electrode (1) or the reference electrode (2) and the guard electrode (4) is controlled to have a magnitude within a prescribed range smaller than a magnitude of a voltage between the spray electrode (1) and the reference electrode (2).

9 Claims, 12 Drawing Sheets

(58) Field of Classification Search
USPC ..... 239/3, 690, 690.1
See application file for complete search history.

(56) References Cited

U.S. PATENT DOCUMENTS

| | | | | |
|---|---|---|---|---|
| 4,854,506 | A | 8/1989 | Noakes et al. | |
| 6,302,331 | B1 * | 10/2001 | Dvorsky | A61M 15/02 239/3 |
| 6,454,193 | B1 | 9/2002 | Busick et al. | |
| 2004/0251326 | A1 | 12/2004 | Pirrie | |
| 2008/0283636 | A1 | 11/2008 | Pirrie | |
| 2010/0258649 | A1 | 10/2010 | Pirrie | |
| 2013/0270371 | A1 | 10/2013 | Pirrie | |
| 2014/0151471 | A1 | 6/2014 | Dau et al. | |
| 2015/0021420 | A1 | 1/2015 | Dau et al. | |

FOREIGN PATENT DOCUMENTS

| | | | |
|---|---|---|---|
| EP | 2 875 870 | A1 | 5/2015 |
| GB | 1 523 089 | A | 8/1978 |
| JP | 2004-530552 | A | 10/2004 |
| JP | 2005-177685 | A | 7/2005 |
| JP | 2007-167761 | A | 7/2007 |
| JP | 2009-172560 | | 8/2009 |
| JP | 2013-027832 | A | 2/2013 |
| JP | 2013-208606 | A | 10/2013 |
| WO | WO-03/000431 | A1 | 1/2003 |
| WO | WO-2004/089552 | A2 | 10/2004 |
| WO | WO-2007/077424 | A1 | 7/2007 |
| WO | WO-2014/014014 | A1 | 1/2014 |

OTHER PUBLICATIONS

International Preliminary report on Patentability issued in corresponding application No. PCT/JP2014/053204 dated Sep. 24, 2015.
International Search Report issued in corresponding application No. PCT/JP2014/053204 dated Mar. 18, 2014.
Extended European Search Report issued in EP Application No. 14762420.9 dated Oct. 14, 2016.
Office Action in corresponding Australian patent application No. 2014232067 dated Oct. 19, 2017.
Australian Office Action Dated Dec. 12, 2017 in corresponding application No. 2014232067.

* cited by examiner

ELECTROSTATIC SPRAYING DEVICE AND METHOD FOR CONTROLLING ELECTROSTATIC SPRAYING DEVICE

TECHNICAL FIELD

The present invention relates to an electrostatic atomizer excellent in spray stability and a method for controlling the electrostatic atomizer.

BACKGROUND ART

Conventionally, an atomizer which sprays a liquid in a container via a nozzle (hereinafter referred to as "spray electrode") has been widely used in various fields. A known example of such an atomizer is an electrostatic atomizer which atomizes and sprays a liquid by Electro Hydrodynamics (EHD). The electrostatic atomizer forms an electric field at a tip of a nozzle and uses the electric field to atomize and spray the liquid from the tip of the nozzle. Patent Literature 1 is known as a document which discloses such an electrostatic atomizer.

CITATION LIST

Patent Literature

[Patent Literature 1]
WO 2004/089552 A2 (Published on Oct. 21, 2004)

SUMMARY OF INVENTION

Technical Problem

However, in a conventional technique disclosed in, for example, Patent Literature 1, there is still a room for improvement in the following points.

In general, an electrostatic atomizer forms an electric field between a reference electrode and a spray electrode, and atomizes and sprays a liquid from a tip of the spray electrode with use of the electric field. There is a case where a conventional electrostatic atomizer requires a time to obtain a desired sprayed amount, particularly in a period right after start of an operation (which can be hereinafter referred to as "start-up period"). The conventional electrostatic atomizer has the following problems: an electric field can become unstable; a sprayed amount can largely vary; and a spray angle of a liquid can become wider. In addition to the above problems, the conventional electric atomizer has a problem that a sprayed liquid returns back to the electrostatic atomizer and wets a surface of the electrostatic atomizer (face-wet).

The present invention is attained in view of the above problems. An object of the present invention is to provide an electrostatic atomizer capable of improving spray stability.

Solution to Problem

In order to solve the foregoing problems, an electrostatic atomizer in accordance with one aspect of the present invention includes: a first electrode which sprays a substance from a tip, the first electrode being provided inside a first opening formed at a surface of the electrostatic atomizer; a second electrode being one of two electrodes between which a voltage is applied, the first electrode being another one of the two electrodes, the second electrode being provided inside a second opening formed at the surface of the electrostatic atomizer; and a third electrode being different from the first electrode and the second electrode and provided between the first opening and the second opening, the third electrode being one of two electrodes between which a voltage is applied, the first electrode or the second electrode being another one of the two electrodes, the voltage between the first electrode or the second electrode and the third electrode being controlled so as to have a magnitude within a prescribed range smaller than a magnitude of the voltage between the first electrode and the second electrode.

In order to solve the foregoing problems, a method in accordance with one aspect of the present invention for controlling an electrostatic atomizer is a method for controlling an electrostatic atomizer, the electrostatic atomizer including: a first electrode which sprays the substance from a tip; a second electrode being one of two electrodes between which a voltage is applied, the first electrode being another one of the two electrodes; and a third electrode being provided between the first electrode and the second electrode and different from the first electrode and the second electrode, the method comprising the steps of: applying a first voltage between the first electrode and the second electrode; and controlling a voltage between the first electrode or the second electrode and the third electrode so that the voltage between the first electrode or the second electrode and the third electrode has a magnitude within a prescribed range smaller than a magnitude of the voltage between the first electrode and the second electrode.

In an electrostatic atomizer, a voltage is applied between a first electrode and a second electrode, so that an electric field is formed between the first electrode and the second electrode. At this time, the first electrode is charged positively and the second electrode is charged negatively (and vice versa). Thus, the first electrode sprays positively charged substance. Meanwhile, the second electrode ionizes and negatively charges air in the vicinity of the second electrode. Then, the negatively charged air moves away from the second electrode, due to the electric field formed between the first electrode and the second electrode and a repulsive force among particles of the negatively charged air. This movement creates an air flow (hereinafter, the air flow can also be referred to as an ion stream), and the positively charged substance is sprayed in a direction away from the electrostatic atomizer due to the ion stream.

The inventors of the present invention have found that the conventional electrostatic atomizer has a potential problem that a desired sprayed amount cannot be obtained particularly in a start-up period which is a period right after start of an operation. In regard to this problem, the inventors of the present invention have found that spray stability during the start-up period is improved in a case where: a third electrode different from the first electrode and the second electrode is provided between the first opening and the second opening; and a magnitude of a voltage applied between the first electrode or the second electrode and the third electrode is within a prescribed range smaller than a magnitude of a voltage between the first electrode and the second electrode.

Accordingly, by setting the magnitude of the voltage applied between the first electrode or the second electrode and the third electrode within the prescribed range within which spray stability is improved, the electrostatic atomizer in accordance with one aspect of the present invention can improve spray stability throughout an operation period including the start-up period.

It should be noted that the "prescribed range" varies depending on the magnitude of the voltage applied between the first opening and the second opening or the like, and is not determined uniquely.

Advantageous Effects of Invention

An electrostatic atomizer of the present invention is configured to include: a first electrode which sprays a substance from a tip, the first electrode being provided inside a first opening formed at a surface of the electrostatic atomizer; a second electrode being one of two electrodes between which a voltage is applied, the first electrode being another one of the two electrodes, the second electrode being provided inside a second opening formed at the surface of the electrostatic atomizer; and a third electrode being different from the first electrode and the second electrode and provided between the first opening and the second opening, the third electrode being one of two electrodes between which a voltage is applied, the first electrode or the second electrode being another one of the two electrodes, so that the voltage between the first electrode or the second electrode and the third electrode can be controlled so as to have a magnitude within a prescribed range smaller than a magnitude of the voltage between the first electrode and the second electrode.

A method of the present invention for controlling an electrostatic atomizer is a method for controlling an electrostatic atomizer, the electrostatic atomizer including: a first electrode which sprays the substance from a tip; a second electrode being one of two electrodes between which a voltage is applied, the first electrode being another one of the two electrodes; and a third electrode being provided between the first electrode and the second electrode and different from the first electrode and the second electrode, the method comprising the steps of: applying a first voltage between the first electrode and the second electrode; and controlling a voltage between the first electrode or the second electrode and the third electrode so that the voltage between the first electrode or the second electrode and the third electrode has a magnitude within a prescribed range smaller than a magnitude of the voltage between the first electrode and the second electrode.

Therefore, the electrostatic atomizer of the present invention and the method of the present invention for controlling the electrostatic atomizer can yield an effect of improving spray stability.

DESCRIPTION OF EMBODIMENTS

Figure 1:
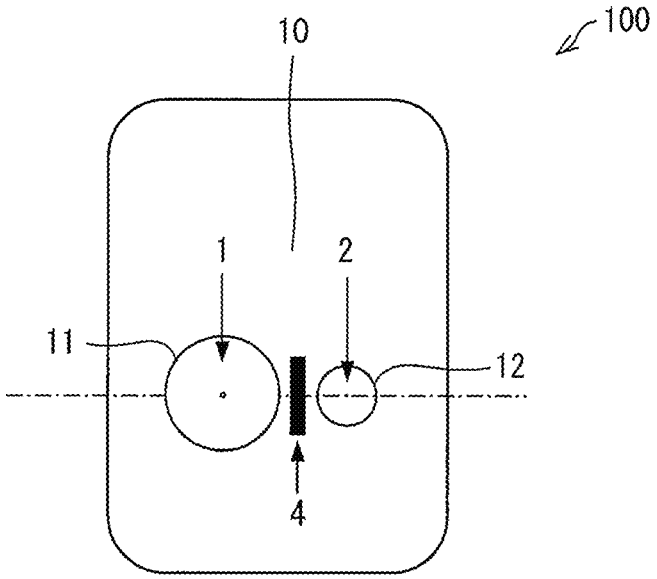
FIG. 1 is a view schematically illustrating an electrostatic atomizer in accordance with the present embodiment.

The following discusses an electrostatic atomizer 100 of the present embodiment with reference to drawings. In the following description, identical members and components are given identical reference signs, respectively, and have identical names and identical functions. Thus, detailed descriptions of the members and components are not repeated.

[Electrostatic Atomizer 100]

The electrostatic atomizer 100 is used for, for example, spraying aromatic oil, a chemical substance for an agricultural product, a medicine, an agricultural chemical, a pesticide, an air cleaning agent, and the like. The electrostatic atomizer 100 includes a spray electrode 1 (a first electrode), a reference electrode 2 (a second electrode), a power supply device 3, and a guard electrode 4 (a third electrode).

Figure 2:
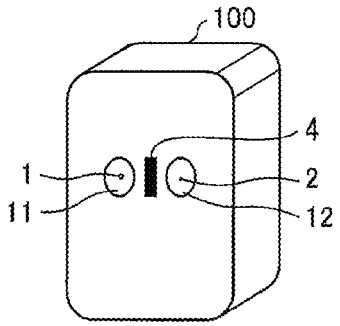
FIG. 2 is a view illustrating an appearance of the electrostatic atomizer in accordance with the present embodiment.

First, the following discusses an appearance of the electrostatic atomizer 100 with reference to FIG. 2. FIG. 2 is a view illustrating an appearance of the electrostatic atomizer 100.

As illustrated in FIG. 2, the electrostatic atomizer 100 has a rectangular parallelepiped shape. The spray electrode 1 and the reference electrode 2 are provided on one surface of the electrostatic atomizer 100. The spray electrode 1 is provided in the vicinity of the reference electrode 2. Further, a circular opening 11 (first opening) and a circular opening 12 (second opening) are provided so as to surround the spray electrode 1 and the reference electrode 2, respectively. A voltage (first voltage) is applied between the spray electrode 1 and the reference electrode 2, so that an electric field is formed between the spray electrode 1 and the reference electrode 2. The spray electrode 1 sprays a positively charged droplet. The reference electrode 2 ionizes and negatively charges air in the vicinity of the reference electrode 2. Then, the negatively charged air moves away from the reference electrode 2, due to the electric field formed between the spray electrode 1 and the reference electrode 2 and a repulsive force among particles of the negatively charged air. This movement creates an air flow (hereinafter, the air flow can also be referred to as an ion stream), and the positively charged droplet is sprayed in a direction away from the electrostatic atomizer 100 due to the ion stream.

The guard electrode 4 is provided between the opening 11 and the opening 12. The shape of the guard electrode 4 is not limited to a rectangular shape as illustrated in FIG. 2, but can be a shape of a line, a point and the like. The guard electrode 4 is provided between the opening 11 and the opening 12, and more preferably provided in such a manner as to overlap an imaginary line connecting the spray electrode 1 and the reference electrode 2 so that an electric field formed at a tip of the spray electrode 1 can be suitable for spraying a substance.

The electrostatic atomizer 100 is not limited to the rectangular parallelepiped shape but can have other shape. Further, the opening 11 and the opening 12 each are not limited in shape but can have a shape other than a circular shape. The opening 11 and the opening 12 each can also have an opening size which is adjusted appropriately.

[Spray Electrode 1, Reference Electrode 2, and Guard Electrode 4]

Figure 3:
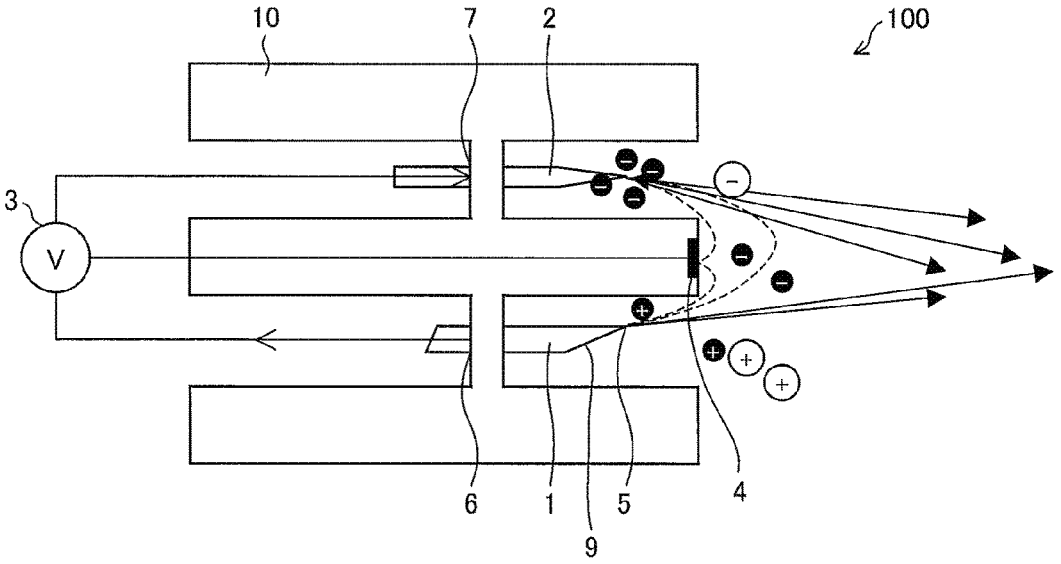
FIG. 3 is a view illustrating a spray electrode, a reference electrode, and a guard electrode in accordance with the present embodiment.

The following discusses the spray electrode 1, the reference electrode 2, and the guard electrode 4 with reference to FIG. 3. FIG. 3 is a view illustrating the spray electrode 1, the reference electrode 2, and the guard electrode 4.

The spray electrode 1 includes a conductive conduit such as a metallic capillary (e.g., type 304 stainless steel), and a tip 5 which is a tip of the spray electrode 1. The spray electrode 1 is electrically connected with the reference electrode 2 via the power supply device 3. The spray electrode 1 sprays a substance to be atomized (hereinafter simply referred to as "substance") from the tip 5. The spray electrode 1 has an inclined plane 9, which inclines with respect to an axial center of the spray electrode 1 and has a shape that becomes thinner and sharper toward the tip 5 of the spray electrode 1.

The reference electrode 2 includes a conductive rod such as a metal pin (e.g., type 304 steel pin). The spray electrode 1 and the reference electrode 2 are provided parallel with each other so as to be spaced apart from each other with a prescribed distance therebetween. The spray electrode 1 and the reference electrode 2 are provided so as to be spaced apart from each other by a distance of, for example, 8 mm.

The power supply device 3 is provided for applying a high voltage between the spray electrode 1 and the reference electrode 2. For example, the power supply device 3 applies a high voltage of 1 kV to 30 kV (e.g., 3 kV to 7 kV) between the spray electrode 1 and the reference electrode 2. When a high voltage is applied between the spray electrode 1 and the reference electrode 2, an electric field is formed between the spray electrode 1 and the reference electrode 2. This causes an electric dipole inside a dielectric 10. At this point in time, the spray electrode 1 is positively charged, and the reference electrode 2 is negatively charged (alternatively, the spray electrode 1 can be negatively charged, and the reference electrode 2 can be positively charged). Then, a negative dipole occurs on a surface of the dielectric 10 which surface is the closest to the spray electrode 1 that is positively-charged, and a positive dipole occurs on a surface of the dielectric 10 which surface is the closest to the reference electrode 2 that is negatively-charged, so that a charged gas and a charged substance species are released by the spray electrode 1 and the reference electrode 2. As described above, an electric charge generated by the reference electrode 2 at this point in time has a polarity opposite to that of a liquid.

Therefore, the electric charge of the liquid is balanced by an electric charge generated by the reference electrode 2. This allows the electrostatic atomizer 100 to perform stable spray by current feedback control, based on the principle of charge equilibration.

Furthermore, the power supply device 3 also applies a voltage between the spray electrode 1 and the guard electrode 4 and/or between the reference electrode 2 and the guard electrode 4. This will be detailed with reference to FIG. 5.

The guard electrode 4 is an electrode made of a conductive material, and can be, for example, an electric conductor such as conductive plastic. The guard electrode 4 can be provided on the dielectric 10 or inside a cavity or an opening in the dielectric 10.

The guard electrode 4 can be embedded in the electrostatic atomizer 100 so as not to be exposed to the outside. For example, the guard electrode 4 can be covered with a thin dielectric film. This makes it possible to prevent electrification from occurring due to a contact with the guard electrode 4. As above, as long as an electric field formed at the tip of the spray electrode 1 functions as the aforementioned electric field suitable for spraying a substance, the guard electrode 4 can be provided in various forms and at various positions.

As for examples of a voltage adjusting method and examples of an arrangement of the guard electrode 4 in accordance with the present embodiment, various examples will be described later with reference to FIGS. 15 to 22.

The electrostatic atomizer 100 (method for controlling the electrostatic atomizer 100) controls a voltage applied between the spray electrode 1 or the reference electrode 2 and the guard electrode 4 (voltage applying step) so that the voltage applied between the spray electrode 1 or the reference electrode 2 and the guard electrode 4 can have a magnitude within a prescribed range smaller than a magnitude of a voltage applied between the spray electrode 1 and the reference electrode 2 (voltage control step). The prescribed range is a range of a magnitude of a voltage which is to be applied between the spray electrode 1 or the reference electrode 2 and the guard electrode 4 and which allows improving spray stability during a start-up period. In a case where a liquid sprayed from the spray electrode 1 has a Taylor cone shape, spray can be considered stable.

The dielectric 10 is made of a dielectric material such as nylon 6, nylon 11, nylon 12, polypropylene, nylon 66, or a polyacetyl-polytetrafluoroethylene mixture. The dielectric 10 supports the spray electrode 1 at a spray electrode mounting section 6 and also supports the reference electrode 2 at a reference electrode mounting section 7.

[Power Supply Device 3]

Figure 4:
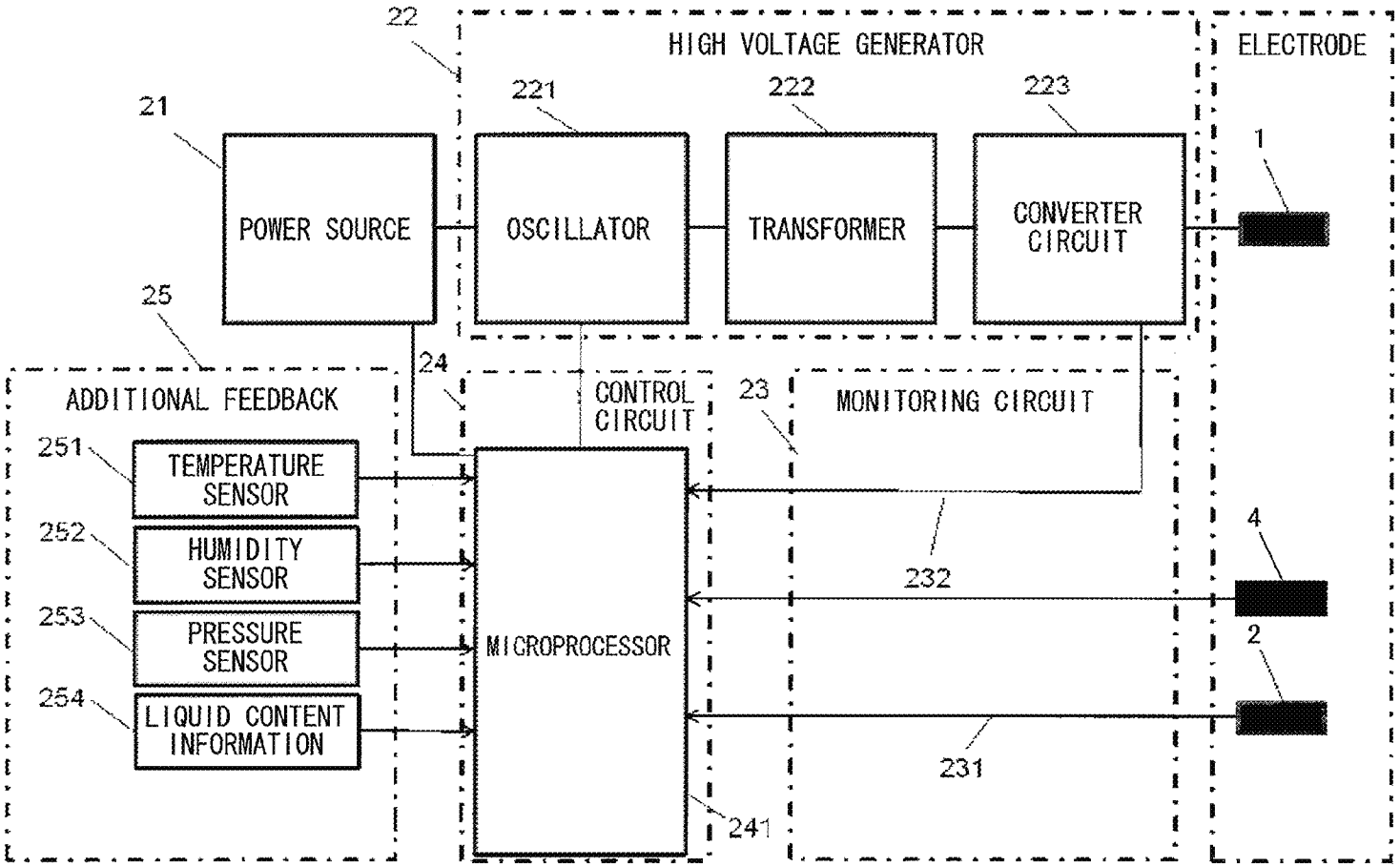
FIG. 4 is a view illustrating an example configuration of a power supply device in accordance with the present embodiment.

FIG. 4 is a view illustrating an example configuration of the power supply device 3. The power supply device 3 includes a power source 21, a high voltage generator 22, a monitoring circuit 23 adapted to monitor output voltages at the spray electrode 1 and the reference electrode 2, and a control circuit (current control section, voltage control section) 24 adapted to control the high voltage generator 22 so that an output voltage of the high voltage generator 22 can have a desired value in a state in which a value of a current at the reference electrode 2 is controlled to be a prescribed value (within a prescribed range). For various practical applications, the control circuit 24 can include a microprocessor 241. The microprocessor 241 can be designed to allow further adjustment of an output voltage and a spray time based on other feedback information 25. The feedback information 25 includes environmental conditions (temperature, humidity, and/or atmospheric pressure), a liquid amount, an optional user setting, and the like. Furthermore, the control circuit 24 can control a magnitude of a voltage between the spray electrode 1 or the reference electrode 2 and the guard electrode 4 so that the magnitude of the voltage between the spray electrode 1 or the reference electrode 2 and the guard electrode 4 can be within a prescribed range smaller than a magnitude of a voltage between the spray electrode 1 and the reference electrode 2.

The power source 21 can be a well-known power source and includes a main power source or at least one battery.

The power source 21 is preferably a low voltage supply, or a direct current (DC) power supply. For example, one or more voltaic cells can be combined to form a battery. A suitable battery includes one or more AA- or D-cell batteries. The number of batteries is determined by a required voltage level and a power consumption of the power source.

Figure 5:
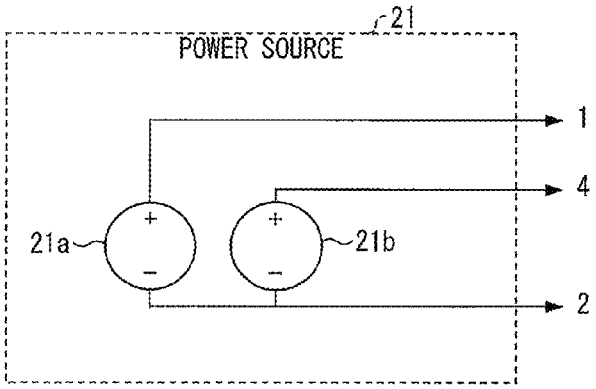
FIG. 5 is a view illustrating a power source in accordance with the present embodiment.

The following further discusses the power source 21 with reference to FIG. 5. FIG. 5 is a view illustrating the power source 21.

The power source 21 includes a power source 21*a* and a power source 21*b*. The power source 21*a* applies a voltage between the spray electrode 1 and the reference electrode 2.

The power source 21*b* applies a voltage between the reference electrode 2 and the guard electrode 4. Alternatively, the power source 21*b* can apply a voltage between the spray electrode 1 and the guard electrode 4. With use of the power source 21*b*, the electrostatic atomizer 100 can control a voltage between the spray electrode 1 or the reference electrode 2 and the guard electrode 4 so that the voltage between the spray electrode 1 or the reference electrode 2 and the guard electrode 4 has a magnitude within a prescribed range which is within a range of a voltage applied between the spray electrode 1 and the reference electrode 2.

A voltage can be applied between the guard electrode 4 and the spray electrode 1 or the reference electrode 2 by various methods other than the above method. Examples of such methods encompass a current feedback control in which a value of a current at the guard electrode 4 is controlled to be within a prescribed range (to be a prescribed value), a voltage feedback control in which a voltage between the spray electrode 1 and the guard electrode 4 or a voltage between the reference electrode 2 and the guard electrode 4 is controlled to be within a prescribed range (to be a prescribed value), and a combination of the current feedback control and the voltage feedback control. Among the above feedback controls, the current feedback control can stabilize an amount of a substance sprayed from the spray electrode 1 even in a case where a large voltage is applied between the spray electrode 1 and the reference electrode 2 and therefore is preferably applied. The current feedback control will be detailed later.

The current feedback control and the voltage feedback control each can be performed by software built in the microprocessor 241.

The present embodiment can alternatively be realized by a configuration as follows. Specifically, the power source 21 includes only the power source 21*a*, but does not include the power source 21*b*. In this configuration, no current flows through the guard electrode 4 (the guard electrode 4 is floating). On the other hand, the power source 21*a* applies a voltage between the spray electrode 1 and the reference electrode 2. This configuration does not require the power source 21*b*. Therefore, the configuration can reduce a production cost for the electrostatic atomizer and contribute to downsizing of the electrostatic atomizer.

The high voltage generator 22 includes an oscillator 221 which converts DC to AC, a transformer 222 that is driven by AC, and a converter circuit 223 connected to the transformer 222. The converter circuit 223 typically includes a charge pump and a rectifier circuit. The converter circuit 223 generates a desired voltage and converts AC back into DC. A typical converter circuit is a Cockcroft-Walton generator.

The monitoring circuit 23 includes a current feedback circuit 231, and can also include a voltage feedback circuit 232 depending on an application. The current feedback circuit 231 measures an electric current at the reference electrode 2. Because the electrostatic atomizer 100 is charge balanced, measurement of the current at the reference electrode 2 and reference to thus measured current provide an accurate monitor of the current at the tip 5 of the spray electrode 1. Such a method eliminates the necessity of provision of an expensive, complex or disruptive measuring section to the tip 5 of the spray electrode 1, and also eliminates the necessity of estimating contribution of a discharge current (corona current) to a measured current. The current feedback circuit 231 can include any conventional current measurement device, for example, a current transformer.

In a preferred embodiment, the current at the reference electrode 2 is measured by measuring a voltage across a set resistor (feedback resistor) which is series-connected with the reference electrode 2. In an embodiment, the voltage measured across the set resistor is read by using an analogue to digital (A/D) converter, which is typically part of the microprocessor. A suitable microprocessor with an A/D converter encompasses a microprocessor of the PIC16F18** family produced by Microchip. The digital information is processed by the microprocessor to provide an output for the control circuit 24.

In a preferred embodiment, the voltage measured across the set resistor is compared with a prescribed constant reference voltage level by using a comparator. Comparators require only very low current input (typically nanoampere or lower) and make a fast response. The microprocessor 241 often provides built-in comparators for such a purpose. For example, PIC16F1824 of the above mentioned microchip family provides a suitable comparator with very low current input and constant reference voltage. The reference voltage level to be inputted to the comparator is set by use of a D/A converter that is also included in the microprocessor 241. Here, selectable reference voltage levels are provided in advance. In typical operation, this circuit is able to detect whether the measured current is below or above a requested level that is determined by the magnitude of reference voltage and the feedback resistor, and to supply the information to the control circuit 24.

In applications where the knowledge of a precise voltage value is required, the monitoring circuit 23 also includes the voltage feedback circuit 232, measuring the applied voltage to the spray electrode 1. Typically, the applied voltage is directly monitored by measuring the voltage at a junction of two resistors forming a potential divider connected between two electrodes. Alternatively, the applied voltage can be monitored by measuring a voltage developed at a node within the Cockcroft-Walton generator, by using the same potential divider principle. Similarly, as for current feedback, the feedback information can be processed either via an A/D converter or by comparing a feedback signal with a reference voltage level by using a comparator.

The control circuit 24 obtains information indicative of a value of a current at the reference electrode 2 from the monitoring circuit 23, and compares the value of the current at the reference electrode 2 with a prescribed current value (e.g. 0.867 μA). In a case where the value of the current at the reference electrode 2 is not a prescribed current value, the control circuit 24 controls the value of the current at the reference electrode 2 so that the value can become the prescribed current value. Then, after the control circuit 24 controls the value of the current at the reference electrode 2 so that the value can become the prescribed current value, the control circuit 24 controls an amplitude, a frequency, or a duty cycle of oscillation in the oscillator 211, or an on/off time of a voltage (or combinations thereof) so as to control an output voltage of the high voltage generator 22. The control circuit 24 can control the value of the current at the reference electrode 2 so that the value can be within a prescribed range having a certain extent (±5%), instead of the above control with use of the "prescribed current value".

In order to compensate for a voltage or a duty cycle/spray period in accordance with an atmospheric temperature, a humidity, an atmospheric pressure, an amount of a liquid, etc., other input (feedback information 25) can be supplied to the microprocessor 241. The information is provided in the form of analog information or digital information, and processed by the microprocessor 241. The microprocessor 241 can provide compensation for improving spray quality and spray stability, by altering the spray period, an on time of spray or the applied voltage in accordance with the inputted information.

As an example, the power supply device 3 includes a temperature detecting element, such as a thermistor, which is used for compensation of a temperature. In one embodiment, the power supply device 3 varies the spray period in accordance with a change in temperature detected by the temperature detecting element. The spray period is the sum of the on and off times of the power supply. For example, in a case of a cyclical spray period in which the power supply is turned on for 35 seconds (during which time the power supply applies a high voltage between the first electrode and the second electrode) and is turned off for 145 seconds (during which time the power supply does not apply a high voltage as above), the spray period is 35+145=180 seconds. The spray period can be varied by software built in the microprocessor 241 in the power supply device 3 such that the spray period is increased from a set point as temperature increases and the spray period is decreased from the set point as temperature decreases. Preferably, the spray period is increased or decreased in accordance with a prescribed characteristic determined by properties of the substance to be sprayed. For convenience, a compensatory variation of the spray period can be limited such that the spray period is only varied between 0 to 60° C. (e.g., 10 to 45° C.), thereby assuming that extreme temperatures registered by the temperature detecting element are faults and are discounted whilst still providing an acceptable albeit non-optimized spray period for low and high temperature conditions. Alternatively, the on and off times of the spray period can be adjusted so as to keep the spray period constant, but to increase or decrease the spray time within the spray period as temperature decreases or increases.

The power supply device 3 can further include an inspection circuit for detecting a property of the substance to be sprayed, and generating information indicative of the property of the substance to be sprayed. The information, indicative of the property of the substance to be sprayed, which has been generated by the inspection circuit, is supplied to the control circuit 24. The control circuit 24 utilizes the information to compensate at least one voltage control signal. The voltage control signal is a signal generated according to a result obtained by detection of ambient environmental conditions (such as temperature, humidity, and/or atmospheric pressure, and/or sprayed amount), and a signal for adjusting an output voltage or a spray time. The power supply device 3 can include a pressure sensor for monitoring an ambient pressure (atmospheric pressure).

An internal configuration of the power supply device 3 has been discussed above. However, the above description deals with only an example of the power supply device 3. The power supply device 3 can be provided so as to have another configuration, provided that the power supply device 3 has the above described functions.

[Spray Stability in Conventional Electrostatic Atomizer]

In the electrostatic atomizer 100, when an operation starts, a voltage is applied between the spray electrode 1 and the reference electrode 2, so that an electric field is formed at the tip 5 of the spray electrode 1. When the electric field is formed and an electrostatic force exceeds a certain level of strength, liquid droplets are sprayed from the tip 5 of the spray electrode 1. In a good spray state, a liquid sprayed from the tip 5 of the spray electrode 1 forms a Taylor cone which is a circular cone shape. The circular-cone-shaped liquid formed at the tip 5 of the spray electrode 1 is typically called a Taylor cone, and is formed in a case where a surface tension of the liquid toward the tip 5 of the spray electrode 1 is in equilibrium with the electrostatic force generated by the electric field. In a case where the liquid sprayed from the spray electrode 1 has a Taylor cone shape, the spray can be considered stable. That is, a certain level of electric field strength is required for realizing spray stability.

The dielectric 10 is considered as a factor which influences strength of the electric field formed between the spray electrode 1 and the reference electrode 2. When a voltage is applied between the spray electrode 1 and the reference electrode 2, the dielectric 10 is charged with positive and negative electric charges generated at the spray electrode 1 and the reference electrode 2, respectively. The inventors of the present invention have found that the electric charges charging the dielectric 10 influence the electric field formed between the spray electrode 1 and the reference electrode 2, which can consequently influence spray stability of the electrostatic atomizer 100. There is a case where the electrostatic atomizer 100 cannot provide a desired sprayed amount in a period right after start of an operation (which period can be hereinafter referred to as "start-up period"). The electrostatic atomizer 100 which cannot provide a desired sprayed amount in the start-up period is considered to have a room for improvement in spray stability.

Figure 6:
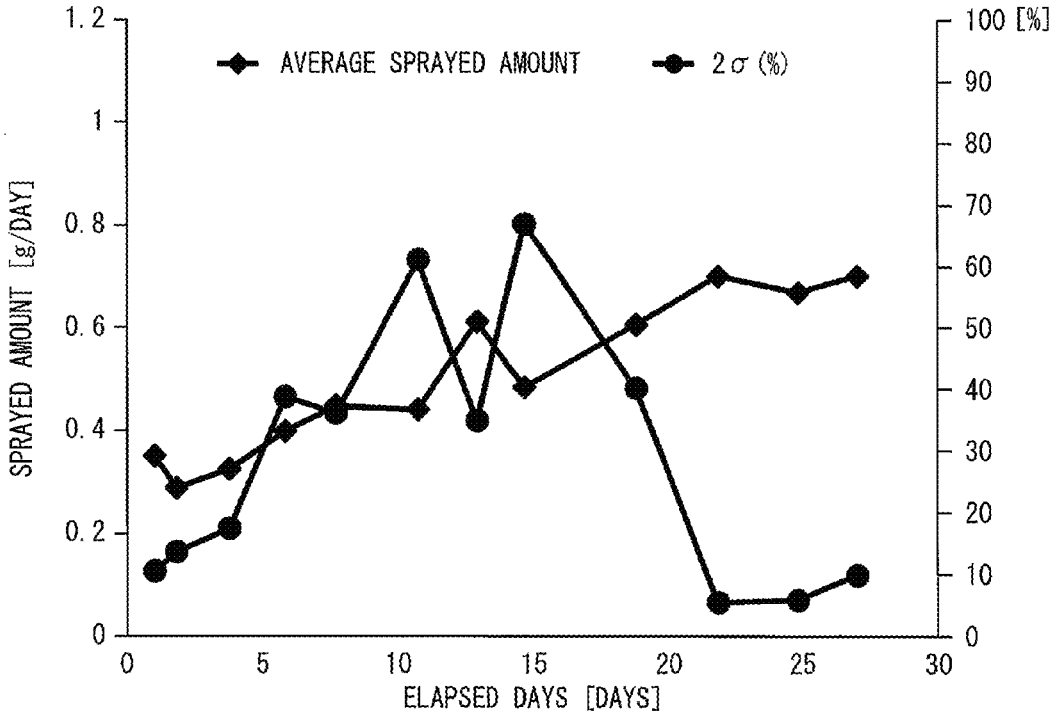
FIG. 6 is a graph showing a relation between days and a sprayed amount in a case where a conventional electrostatic atomizer is used.

With reference to FIG. 6, the following discusses a relation between the dielectric 10 and spray stability. FIG. 6 is a graph for explaining a relation between days and a sprayed amount in a case where a conventional electrostatic atomizer is used. In FIG. 6, a horizontal axis represents lapsed days (days), a vertical axis on the left represents a sprayed amount (g/day), and a vertical axis on the right represents a double standard deviation ($2\alpha$) of the sprayed amount. The present data is obtained as a result of 10 spray tests. A substance to be sprayed is a liquid whose conductivity is 280 μS/m at 25 degrees in temperature and 55% in relative humidity. The conventional electrostatic atomizer is an electrostatic atomizer which does not include an electrode corresponding to the guard electrode 4 of the electrostatic atomizer 100.

In the case of FIG. 6, the sprayed amount is small right after start of the operation, and gradually increases as time lapses. Moreover, $2\alpha$ is greater than 70% at the highest. This shows that the sprayed amount varies greatly.

Figure 7:
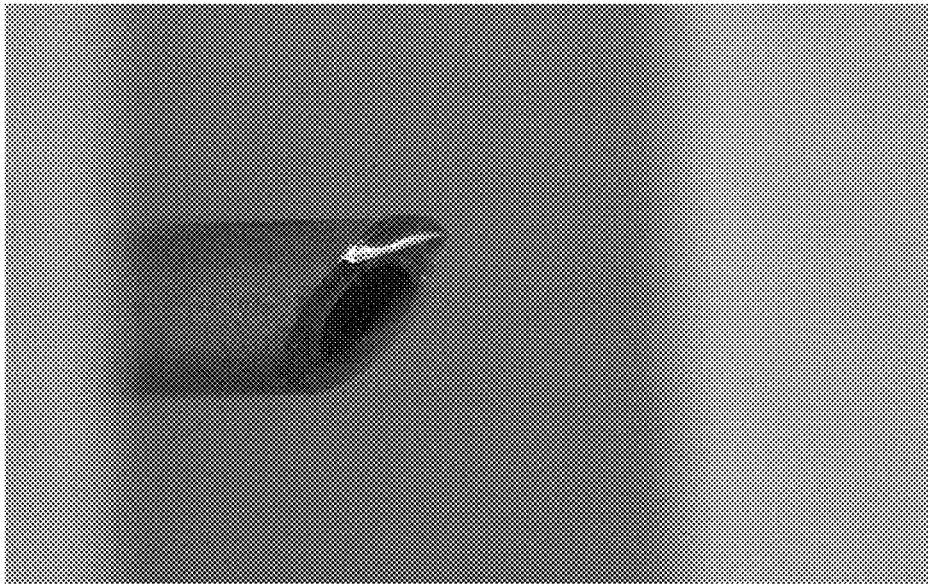
FIG. 7 is a view showing a photograph of a tip at a time point 3 days after start of an operation in a case where the conventional electrostatic atomizer is used.
Figure 8:
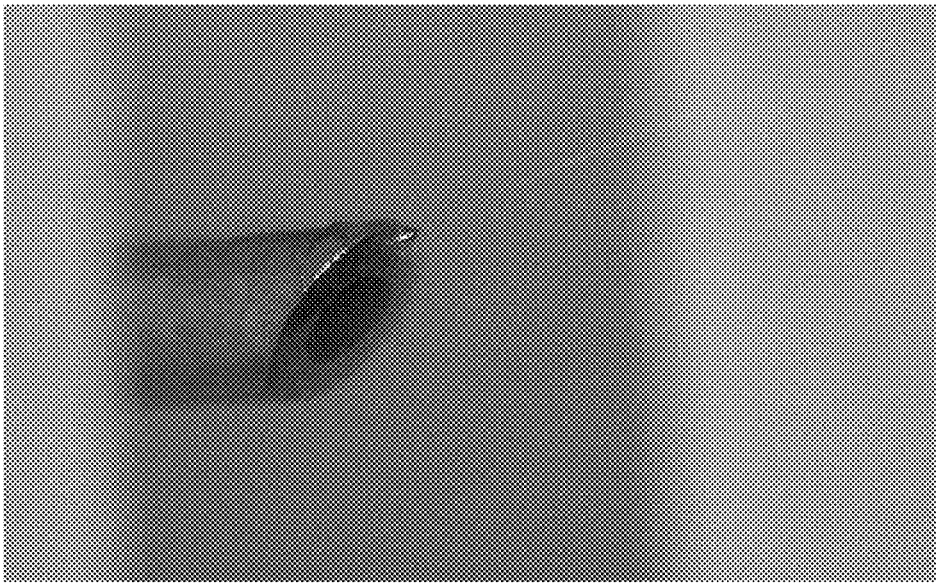
FIG. 8 is a view showing a photograph of a tip of a spray electrode 1 at a time point 25 days after start of the operation in the case where the conventional electrostatic atomizer is used.

FIG. 7 shows a photograph of the tip of the spray electrode 1 at a time point 3 days after start of the operation in a case where the conventional electrostatic atomizer is used. FIG. 8 shows a photograph of the tip of the spray electrode 1 at a time point 25 days after start of the operation in the case where the conventional electrostatic atomizer is used. As illustrated in FIG. 7, at the time point 3 days after start of the operation, no spray having a Taylor cone shape is observed at the tip of the spray electrode 1. On the other hand, as illustrated in FIG. 8, at the time point 25 days after start of the operation, spray having a Taylor cone shape is observed at the tip of the spray electrode 1. Also from visual check of FIGS. 7 and 8, it is clear that there is a case where the conventional electrostatic atomizer does not provide a sufficient sprayed amount right after start of the operation.

From the results illustrated in FIGS. 6 through 8, it is found that the conventional electrostatic atomizer has a room for improvement in spray stability right after start of the operation in particular.

[Spray Stability of Electrostatic Atomizer 100]

In order to improve spray stability during the start-up period, the electrostatic atomizer 100 includes the guard electrode 4 between the opening 11 formed so as to surround the spray electrode 1 and the opening 12 formed so as to surround the reference electrode 2, more preferably, between the spray electrode 1 and the reference electrode 2. The spray atomizer 100 applies a voltage between the spray electrode 1 or the reference electrode 2 and the guard electrode 4 and forms a strong electric field in the vicinity of the spray electrode 1, thereby improving spray stability. This concept will be discussed with reference to FIG. 9 etc.

Figure 9:
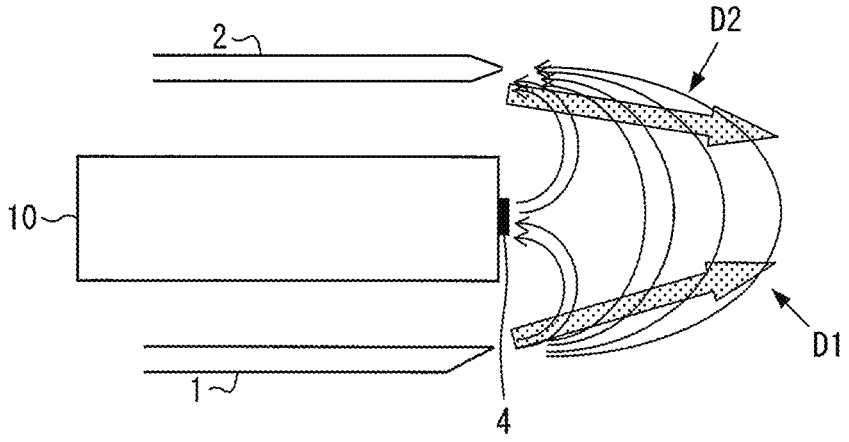
FIG. 9 is a view illustrating a state of an electric field in a case where a magnitude of a voltage applied between the spray electrode and the guard electrode is set to approximately half of a magnitude of a voltage applied between the spray electrode and the reference electrode.

FIG. 9 is a view illustrating a state of an electric field in a case where a magnitude of a voltage applied between the spray electrode 1 and the guard electrode 4 is set to approximately half of a magnitude of a voltage applied between the spray electrode 1 and the reference electrode 2.

In FIG. 9, the magnitude of the voltage applied between the spray electrode 1 and the guard electrode 4 is set to approximately half of the magnitude of the voltage applied between the spray electrode 1 and the reference electrode 2. This strengthens an electric field in the vicinity of the spray electrode 1, so that an electric field suitable for spraying a substance is formed. In FIG. 9, D1 indicates a direction in which the substance is sprayed, and D2 indicates a direction of an ion stream. As indicated by D1, the substance is sprayed in a direction away from the electrostatic atomizer 100 in a case where the magnitude of the voltage applied between the spray electrode 1 and the guard electrode 4 is set to approximately half of the magnitude of the voltage applied between the spray electrode 1 and the reference electrode 2.

Figure 10:
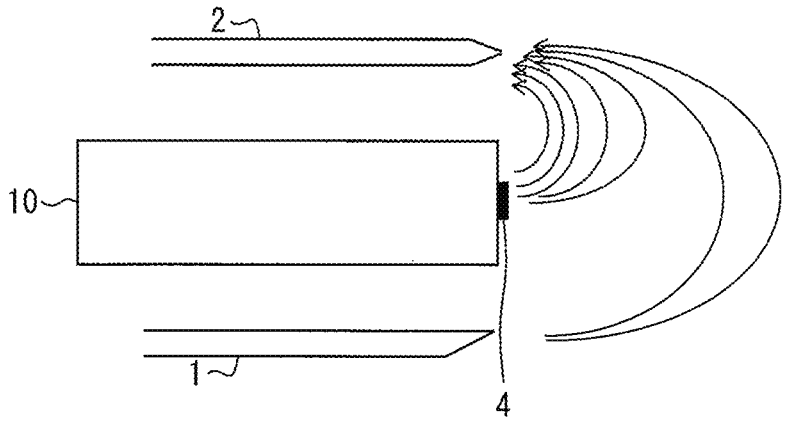
FIG. 10 is a view illustrating a state of an electric field in a case where the magnitude of the voltage applied between the spray electrode and the guard electrode is set a little lower than the magnitude of the voltage applied between the spray electrode and the reference electrode.

FIG. 10 is a view illustrating a state of an electric field in a case where the magnitude of the voltage applied between the spray electrode 1 and the guard electrode 4 is set a little lower than the magnitude of the voltage applied between the spray electrode 1 and the reference electrode 2. In this case, the electric field in the vicinity of the spray electrode 1 weakens, so that no substance is sprayed from the spray electrode 1.

Figure 11:
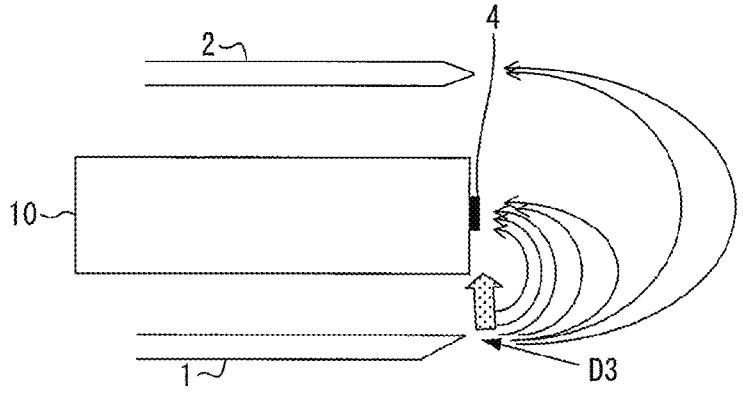
FIG. 11 is a view illustrating a state of an electric field in a case where the magnitude of the voltage applied between the spray electrode and the guard electrode is set extremely lower than the magnitude of the voltage applied between the spray electrode and the reference electrode.

FIG. 11 is a view illustrating a state of an electric field in a case where the magnitude of the voltage applied between the spray electrode 1 and the guard electrode 4 is set extremely lower than the magnitude of the voltage applied between the spray electrode 1 and the reference electrode 2. In this case, an extremely strong electric field is formed in the vicinity of the spray electrode 1. Although a strong electric field is required in order to realize a good spray state, the substance sprayed from the spray electrode 1 travels toward the dielectric 10 and is not sprayed in a direction (corresponding to D1 in FIG. 9) away from the electrostatic atomizer 100 in the case of FIG. 11.

As described above, in the case of FIG. 9, a good spray state can be realized, whereas in the cases of FIGS. 10 and 11, a good spray state cannot be realized. That is, the magnitude of the voltage applied between the spray electrode 1 or the reference electrode 2 and the guard electrode 4 is an important factor for realizing a good spray state.

EXAMPLES

The following discusses three Examples with reference to FIGS. 1 and 12 through 14.

FIG. 1 is a view schematically illustrating the electrostatic atomizer 100 in accordance with the present embodiment. The electrostatic atomizer 100 is used in measurements for FIGS. 12 through 14. As illustrated in FIG. 1, the electrostatic atomizer 100 includes the guard electrode 4 between the opening 11 and the opening 12, more specifically between the spray electrode 1 and the reference electrode 2. The guard electrode 4 has a rectangular shape, and has a length of 2 mm in a long-side direction and a length of 0.5 mm in a short-side direction. The guard electrode 4 is provided on the dielectric 10. A distance between the spray electrode 1 and the reference electrode 2 is 8 mm. The guard electrode 4 is positioned such that a center of the guard electrode 4 in the short-side direction is distanced by 5 mm from the spray electrode 1 and distanced by 3 mm from the reference electrode 2. The guard electrode 4 is positioned also such that a center of the guard electrode 4 in the long-side direction is on or substantially on an imaginary line connecting the spray electrode 1 and the reference electrode 2.

Figure 12:
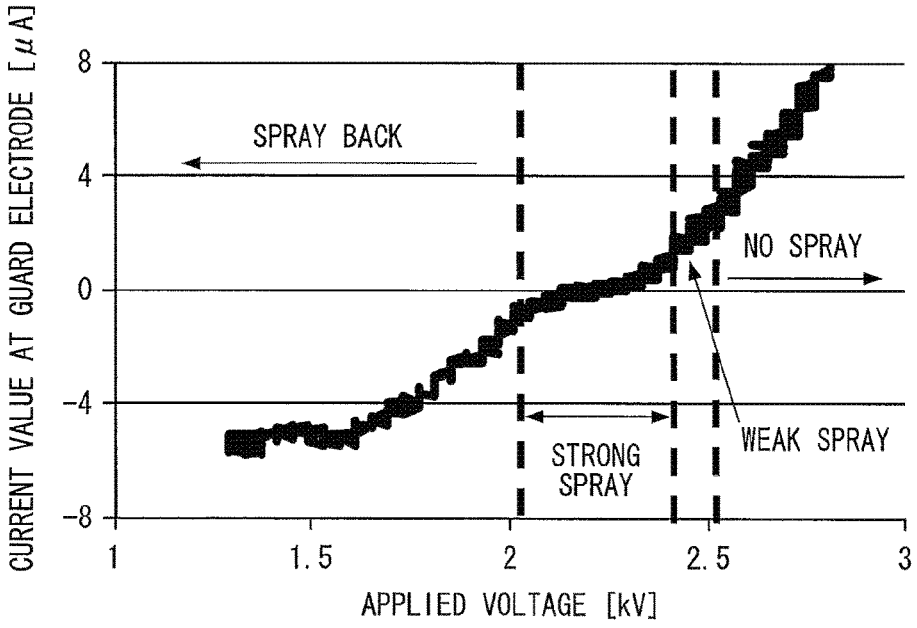
FIG. 12 is a graph illustrating a relation between a voltage applied between the reference electrode and the guard electrode and a value of a current at the guard electrode in a case where a voltage of 6 kV is applied between the spray electrode and the reference electrode.
Figure 13:
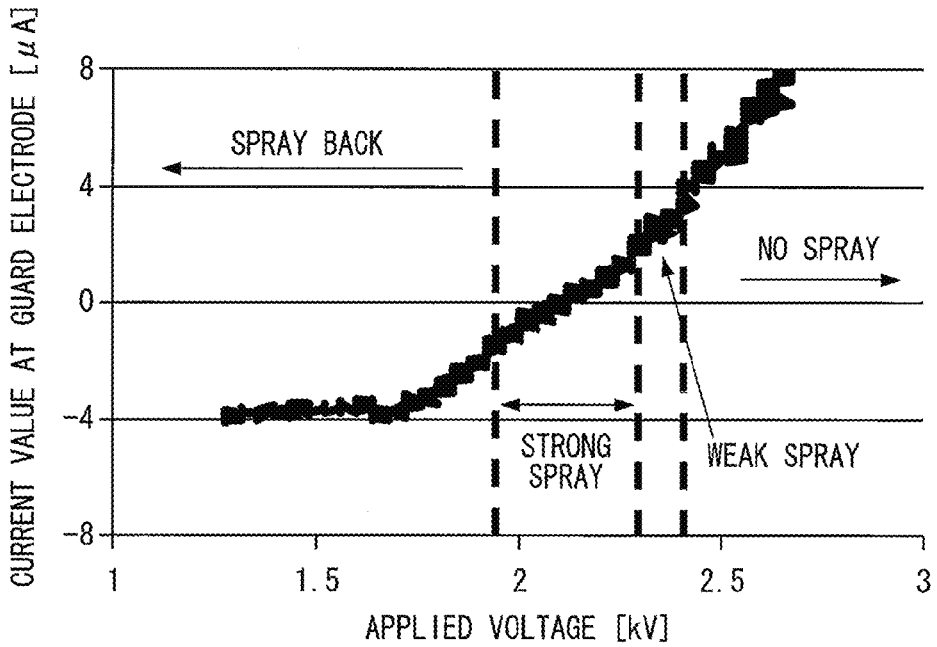
FIG. 13 is a graph illustrating a relation between a voltage applied between the reference electrode and the guard electrode and a value of a current at the guard electrode in a case where a voltage of 5.5 kV is applied between the spray electrode and the reference electrode.
Figure 14:
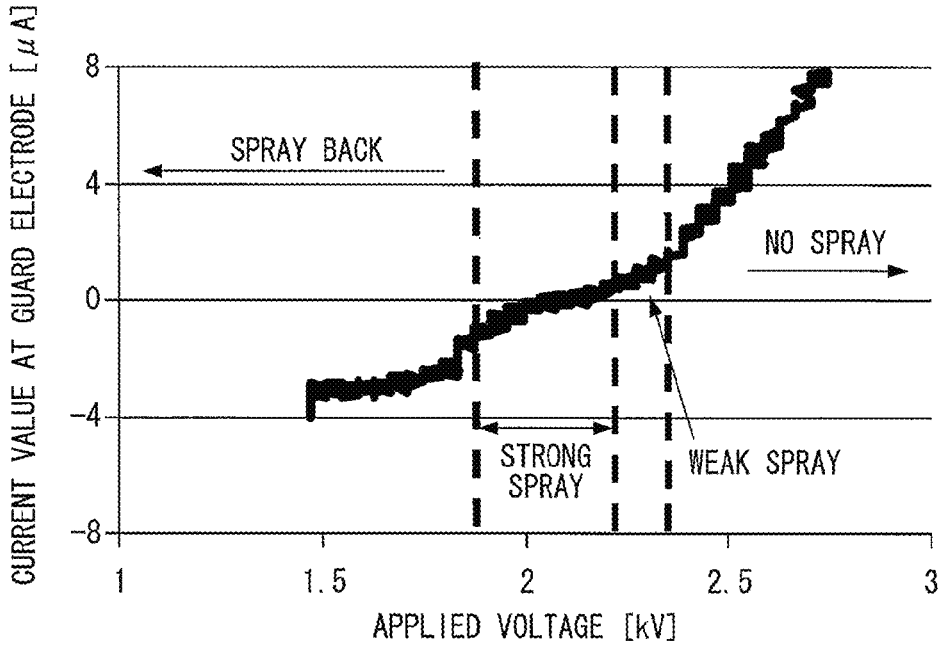
FIG. 14 is a graph illustrating a relation between a voltage applied between the reference electrode and the guard electrode and a value of a current at the guard electrode in a case where a voltage of 5 kV is applied between the spray electrode and the reference electrode.

The aforementioned specifications such as sizes of the guard electrode 4, and the like are those obtained in measurements for FIGS. 12 through 14. Needless to say, the electrostatic atomizer 100 can be realized by various configurations, regardless of the above specifications.

FIG. 12 is a graph illustrating a relation between a voltage applied between the reference electrode 2 and the guard electrode 4 and a value of a current at the guard electrode 4 in a case where a voltage of 6 kV was applied between the spray electrode 1 and the reference electrode 2.

In the graph, a horizontal axis represents a magnitude of the voltage applied between the reference electrode 2 and the guard electrode 4, and a vertical axis represents the value of the current at the guard electrode 4. The voltage applied between the reference electrode 2 and the guard electrode 4 is varied in a range of 1.3 kV to 2.8 kV while the voltage between the spray electrode 1 and the reference electrode 2 is kept constant.

Under the above conditions, the following four states were observed. Specifically, in a case where the voltage applied between the reference electrode 2 and the guard electrode 4 is less than 2 kV, a substance sprayed from the spray electrode 1 travels toward the dielectric 10 (this phenomenon is hereinafter referred to as "spray back"). This is a first state of the four states observed. In this case, since it is necessary to decrease a value of a current caused to flow by positively-charged droplets, the value of the current at the guard electrode 4 is measured as a negative value.

In a case where the voltage applied between the reference electrode 2 and the guard electrode 4 is 2 kV or more and 2.4 kV or less, the substance is sprayed from the spray electrode 1 in a good state, and a Taylor cone is observed at a tip of the spray electrode 1. This is a second state of the four states observed. Furthermore, a target sprayed amount of 0.7 g/day can be achieved. In the above voltage range of 2 kV or more and 2.4 kV or less, positively charged droplets are sprayed in a direction away from a main body of the electrostatic atomizer 100. Note that it is possible to prevent an increase in the value of the current at the guard electrode 4 in a case where the magnitude of the voltage applied between the reference electrode 2 and the guard electrode 4 is increased from 2 kV to 2.4 kV.

In a case where the voltage applied between the reference electrode 2 and the guard electrode 4 is more than 2.4 kV and 2.5 kV or less, the substance is sprayed with a weaker jet force, and the Taylor cone shape of a liquid sprayed from the spray electrode 1 becomes unstable. This is a third state of the four states observed. In the above voltage range of more than 2.4 kV and 2.5 kV or less, the value of the current at the guard electrode 4 is positive. This is because in a case where the voltage applied between the reference electrode 2 and the guard electrode 4 increases, a negative charge generated by the reference electrode 2 is attracted toward the guard electrode 4.

In a case where the voltage applied between the reference electrode 2 and the guard electrode 4 is more than 2.5 kV, no substance is sprayed from the spray electrode 1. This is a fourth state of the four states observed. In other words, it is found from a result of FIG. 12 that in order to realize the second state, the value of the current at the guard electrode 4 should be set within a range of −0.5 μA to 0.5 μA. Then, a good spray state can be realized.

FIG. 13 is a graph illustrating a relation between a voltage applied between the reference electrode 2 and the guard electrode 4 and a value of a current at the guard electrode 4 in a case where a voltage of 5.5 kV is applied between the spray electrode 1 and the reference electrode 2.

In the graph, a horizontal axis represents the voltage applied between the reference electrode 2 and the guard electrode 4, and a vertical axis represents the value of the current at the guard electrode 4. The voltage applied between the reference electrode 2 and the guard electrode 4 is varied in a range of 1.3 kV to 2.8 kV while the voltage between the spray electrode 1 and the reference electrode 2 is kept constant.

Under the above conditions, the following four states were observed. Specifically, in a case where the voltage applied between the reference electrode 2 and the guard electrode 4 is less than 1.9 kV, a substance sprayed from the spray electrode 1 is sprayed back. This is a first state of the four states observed. In this case, since it is necessary to decrease a value of a current caused to flow by positively-charged droplets, the value of the current at the guard electrode 4 is measured as a negative value.

In a case where the voltage applied between the reference electrode 2 and the guard electrode 4 is 1.9 kV or more and 2.3 kV or less, the substance is sprayed from the spray electrode 1 in a good state, and a Taylor cone is observed at the tip of the spray electrode 1. This is a second state of the four states observed. Furthermore, a target sprayed amount of 0.7 g/day can be achieved. In the above voltage range of 1.9 kV or more and 2.3 kV or less, positively charged droplets are sprayed in a direction away from a main body of the electrostatic atomizer 100.

In a case where the voltage applied between the reference electrode 2 and the guard electrode 4 is more than 2.3 kV and 2.4 kV or less, the substance is sprayed with a weaker jet force, and the Taylor cone shape of a liquid sprayed from the spray electrode 1 becomes unstable. This is a third state of the four states observed. In the above voltage range of more than 2.3 kV and 2.4 kV or less, the value of the current at the guard electrode 4 is positive. This is because in a case where the voltage applied between the reference electrode 2 and the guard electrode 4 increases, a negative charge generated by the reference electrode 2 is attracted toward the guard electrode 4.

In a case where the voltage applied between the reference electrode 2 and the guard electrode 4 is more than 2.4 kV, no substance is sprayed from the spray electrode 1. This is a fourth state of the four states observed. In other words, it is found from a result of FIG. 13 that in order to realize the second state, the value of the current at the guard electrode 4 should be set within a range of −1.0 μA to 1.0 μA. Then, a good spray state can be realized.

FIG. 14 is a graph illustrating a relation between a voltage applied between the reference electrode 2 and the guard electrode 4 and a value of a current at the guard electrode 4 in a case where a voltage of 5 kV is applied between the spray electrode 1 and the reference electrode 2. In the graph, a horizontal axis represents the voltage applied between the reference electrode 2 and the guard electrode 4, and a vertical axis represents the value of the current at the guard electrode 4. The voltage applied between the reference electrode 2 and the guard electrode 4 is varied in a range of 1.3 kV to 2.8 kV while the voltage between the spray electrode 1 and the reference electrode 2 is kept constant.

Under the above conditions, the following four states were observed. Specifically, in a case where the voltage applied between the reference electrode 2 and the guard electrode 4 is less than 1.8 kV, a substance sprayed from the spray electrode 1 is sprayed back. This is a first state of the four states observed. In this case, since it is necessary to decrease a value of a current caused to flow by positively-charged droplets, the value of the current at the guard electrode 4 is measured as a negative value.

In a case where the voltage applied between the reference electrode 2 and the guard electrode 4 is 1.8 kV or more and 2.2 kV or less, the substance is sprayed from the spray electrode 1 in a good state, and a Taylor cone is observed at the tip of the spray electrode 1. This is a second state of the four states observed. In the above voltage range of 1.8 kV or more and 2.2 kV or less, positively charged droplets are sprayed in a direction away from a main body of the electrostatic atomizer 100.

In a case where the voltage applied between the reference electrode 2 and the guard electrode 4 is more than 2.2 kV and 2.3 kV or less, the substance is sprayed with a weaker jet force, and the Taylor cone shape of a liquid sprayed from the spray electrode 1 becomes unstable. This is a third state of the four states observed. In the above voltage range of more than 2.2 kV and 2.3 kV or less, the value of the current at the guard electrode 4 is positive. This is because in a case where the voltage applied between the reference electrode 2 and the guard electrode 4 increases, a negative charge generated by the reference electrode 2 is attracted toward the guard electrode 4.

In a case where the voltage applied between the reference electrode 2 and the guard electrode 4 is more than 2.3 kV, no substance is sprayed from the spray electrode 1. This is a fourth state of the four states observed. In other words, it is found from a result of FIG. 13 that in order to realize the second state, the value of the current at the guard electrode 4 should be set within a range of −1.0 μA to 0.5 μA. Then, a good spray state can be realized.

As illustrated in FIGS. 12 through 14, by controlling a voltage applied between the reference electrode 2 and the guard electrode 4 within a prescribed range, the electrostatic atomizer 100 can maintain a good spray state in the second state. In this case, a voltage control can be performed for controlling the voltage applied between the reference electrode 2 and the guard electrode 4 within a prescribed range.

Alternatively, as illustrated in FIGS. 12 through 14, by controlling a current at the guard electrode 4 within a prescribed range, the electrostatic atomizer 100 can maintain a good spray state in the second state. In this case, a current control can be performed for controlling the voltage applied between the reference electrode 2 and the guard electrode 4.

In FIGS. 12 through 14, in a case where a voltage in a range of 5 kV to 6 kV is applied between the spray electrode 1 and the reference electrode 2, the electrostatic atomizer 100 can realize a good spray state by setting the value of the current at the guard electrode 4 within a range of −0.5 μA to 0.5 μA.

It should be noted that the Examples of FIGS. 12 through 14 are merely illustrative, and the value of the voltage applied between the spray electrode 1 and the reference electrode 2 is not limited to those in the above Examples. Regardless of the value of the voltage applied between the spray electrode 1 and the reference electrode 2, the electrostatic atomizer 100 provided with the guard electrode 4 having the aforementioned functions can improve spray stability.

In consideration of the fact that a voltage is more stable than a current, the current feedback control allows a more precise control of a sprayed amount than the voltage feedback control. That is, by controlling the value of the current at the guard electrode 4 so that the value can be within a prescribed range (e.g. −0.5 μA to 0.5 μA) and/or a prescribed value (e.g. 0.1 μA), the electrostatic atomizer 100 can maintain a desirable jet force. This does not depend on the magnitude of the voltage applied between the spray electrode 1 and the reference electrode 2.

As described above, the electrostatic atomizer 100 can improve spray stability by using the guard electrode 4. This effect is more effective in terms of spray stability than an effect obtained by increasing or decreasing a voltage applied between the spray electrode 1 and the reference electrode 2 without using the guard electrode.

[Examples of Voltage Adjusting Method]

Figure 15:
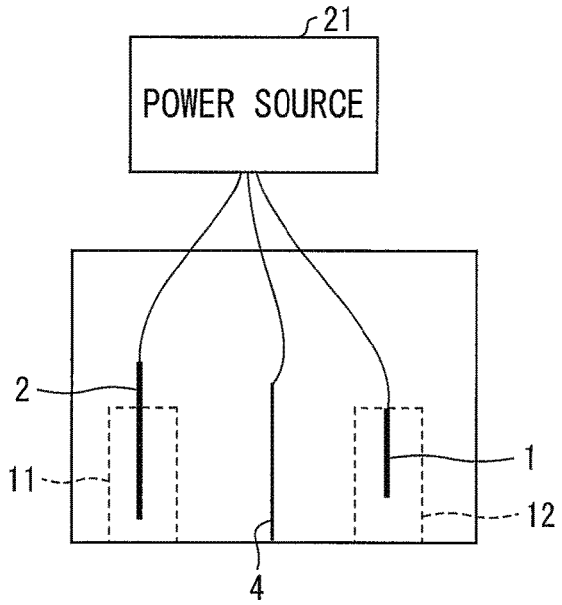
FIG. 15 is a top view illustrating an example of a voltage adjusting method which can be used in the electrostatic atomizer in accordance with the present embodiment.
Figure 16:
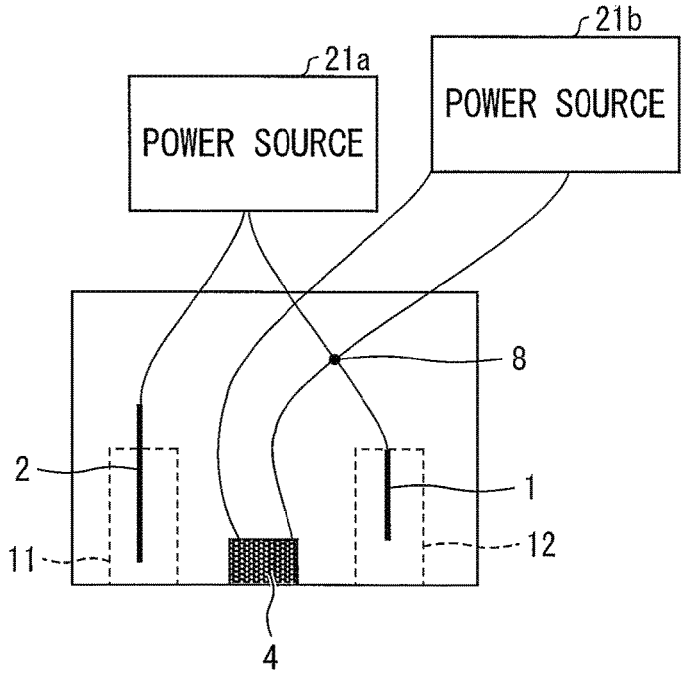
FIG. 16 is a top view illustrating an example of the voltage adjusting method which can be used in the electrostatic atomizer in accordance with the present embodiment.
Figure 17:
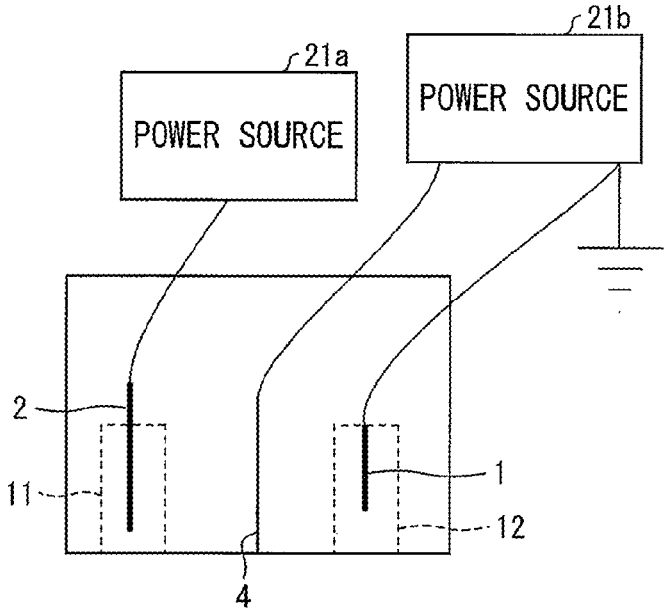
FIG. 17 is a top view illustrating an example of the voltage adjusting method which can be used in the electrostatic atomizer in accordance with the present embodiment.

With reference to FIGS. 15 through 17, the following discusses examples of a voltage adjusting method which can be used in the electrostatic atomizer in accordance with the present embodiment. The examples of the voltage adjusting method in FIGS. 15 through 17 are merely illustrative and the present invention is not limited to these examples. The power source 21 can be provided in the electrostatic atomizer, and the configurations of the power source 21 in FIGS. 15 through 17 are merely illustrative.

FIG. 15 is a top view illustrating an example of the voltage adjusting method which can be used in the electrostatic atomizer in accordance with the present embodiment. The electrostatic atomizer in FIG. 15 includes one power source 21. The power source 21 is connected to the spray electrode 1, the reference electrode 2, and the guard electrode 4. The electrostatic atomizer in FIG. 15 controls, with use of one power source 21, a voltage between the spray electrode 1 or the reference electrode 2 and the guard electrode 4 so that the voltage between the spray electrode 1 or the reference electrode 2 and the guard electrode 4 can have a magnitude within a prescribed range smaller than a magnitude of a voltage applied between the spray electrode 1 and the reference electrode 2.

Since the voltage adjusting method in FIG. 15 uses one power source, it is possible to reduce a production cost for the electrostatic atomizer and simplify a circuit design etc.

FIG. 16 is a top view illustrating an example of the voltage adjusting method which can be used in the electrostatic atomizer in accordance with the present embodiment. The electrostatic atomizer in FIG. 16 includes the power source 21*a* and the power source 21*b*. The power source 21*a* is connected to the spray electrode 1 via a negative electrode 8 and to the reference electrode 2. The power source 21*b* is connected to two points of the guard electrode 4, and the power source 21*b* and one of the two points of the guard electrode 4 are connected via the negative electrode 8. The electrostatic atomizer in FIG. 16 controls, with use of the power source 21*a* and the power source 21*b*, a voltage between the spray electrode 1 or the reference electrode 2 and the guard electrode 4 so that the voltage between the spray electrode 1 or the reference electrode 2 and the guard electrode 4 can have a magnitude within a prescribed range smaller than a magnitude of a voltage applied between the spray electrode 1 and the reference electrode 2.

Since the voltage adjusting method in FIG. 16 uses two power sources, it is possible to perform a more precise voltage control.

FIG. 17 is a top view illustrating an example of the voltage adjusting method which can be used in the electrostatic atomizer in accordance with the present embodiment.

The electrostatic atomizer in FIG. 17 includes the power source 21*a* and the power source 21*b*. The power source 21*a* is connected to the reference electrode 2. The power source 21*b* is connected to the guard electrode 4 and the spray electrode 1 and is grounded. The spray electrode 1 is also grounded. Thus, the electrostatic atomizer in FIG. 17 controls, with use of the power source 21*a* and the power source 21*b*, a voltage between the spray electrode 1 or the reference electrode 2 and the guard electrode 4 so that the voltage between the spray electrode 1 or the reference electrode 2 and the guard electrode 4 can have a magnitude within a prescribed range smaller than a magnitude of a voltage applied between the spray electrode 1 and the reference electrode 2.

Since the voltage adjusting method in FIG. 17 uses two power sources, it is possible to perform a more precise voltage control.

As described above, the electrostatic atomizer in accordance with the present embodiment can adjust a voltage by various methods. Accordingly, it is possible to appropriately change the number of a power source(s) to be used and also a method for connecting the power source(s) and individual electrodes.

[Example Arrangements of the Guard Electrode 4]

With reference to FIGS. 18 through 22, the following discusses example arrangements of the guard electrode 4 in the electrostatic atomizer in accordance with the present embodiment. In FIGS. 18 through 22, for simplicity, electric connections between the spray electrode 1 and the power source and between the reference electrode 2 and the power source are not illustrated. The power source 21 can be provided inside the electrostatic atomizer, and the configuration of the power source 21 is not limited to those in FIGS. 18 through 22.

Figure 18:
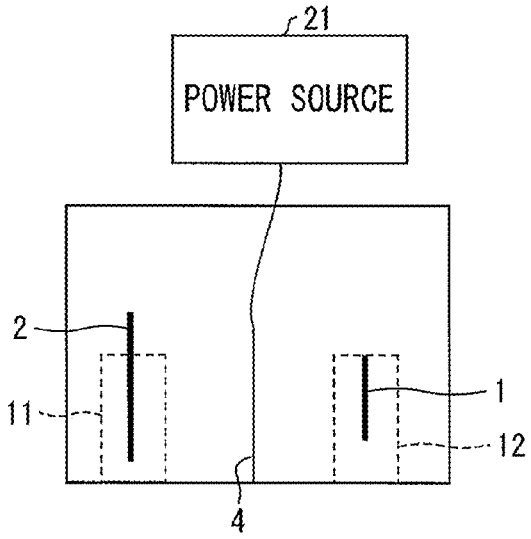
FIG. 18 is a top view illustrating an example arrangement of the guard electrode in the electrostatic atomizer in accordance with the present embodiment.

FIG. 18 is a top view illustrating an example arrangement of the guard electrode 4 in the electrostatic atomizer in accordance with the present embodiment. In the electrostatic atomizer in FIG. 18, the guard electrode 4 positioned between the spray electrode 1 and the reference electrode 2 has a needle shape. Only a tip of the guard electrode 4 is exposed on a surface of the electrostatic atomizer, and the other portion of the guard electrode 4 is provided inside the electrostatic atomizer. One end of the guard electrode 4 having a needle shape, which end is provided inside the electrostatic atomizer, is connected to a negative electrode of the power source 21, so that a voltage at the guard electrode 4 is stabilized.

Figure 19:
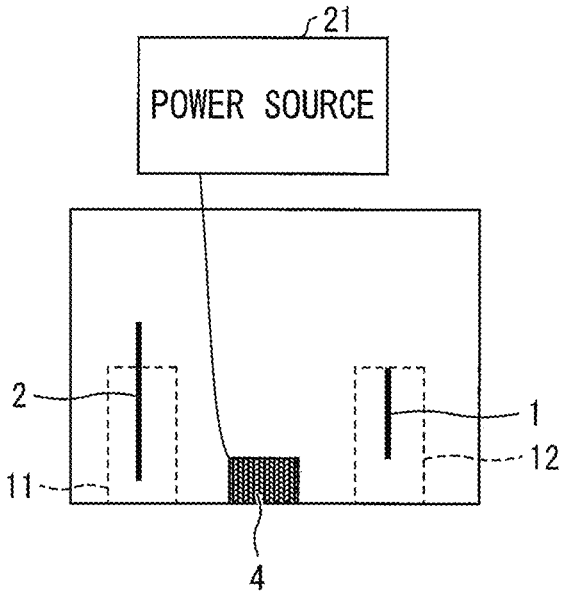
FIG. 19 is a top view illustrating an example arrangement of the guard electrode in the electrostatic atomizer in accordance with the present embodiment.

FIG. 19 is a top view illustrating an example arrangement of the guard electrode 4 in the electrostatic atomizer in accordance with the present embodiment. In the electrostatic atomizer in FIG. 19, the guard electrode 4 positioned between the spray electrode 1 and the reference electrode 2 has a rectangular parallelepiped shape. One plane of the guard electrode 4 is exposed on a surface of the electrostatic atomizer. One corner of the guard electrode 4 having the rectangular parallelepiped shape is connected to a negative electrode of the power source 21. In a case where the guard electrode 4 is made of a conductive material, it can be determined appropriately which portion of the guard electrode 4 is to be connected to the power source 21.

Figure 20:
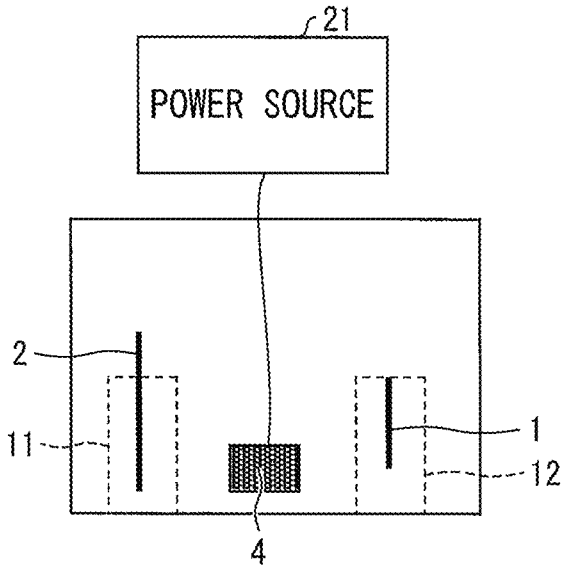
FIG. 20 is a top view illustrating an example arrangement of the guard electrode in the electrostatic atomizer in accordance with the present embodiment.

FIG. 20 is a top view illustrating an example arrangement of the guard electrode 4 in the electrostatic atomizer in accordance with the present embodiment. In the electrostatic atomizer in FIG. 20, the guard electrode 4 positioned between the spray electrode 1 and the reference electrode 2 has a rectangular parallelepiped shape. A whole of the guard electrode 4 is provided inside the electrostatic atomizer, and no part of the guard electrode 4 is exposed on a surface of the electrostatic atomizer. The guard electrode 4 having the rectangular parallelepiped shape is connected to a negative electrode of the power source 21. In a case where the guard electrode 4 is made of a conductive material, it can be determined appropriately which portion of the guard electrode 4 is to be connected to the power source 21.

Figure 21:
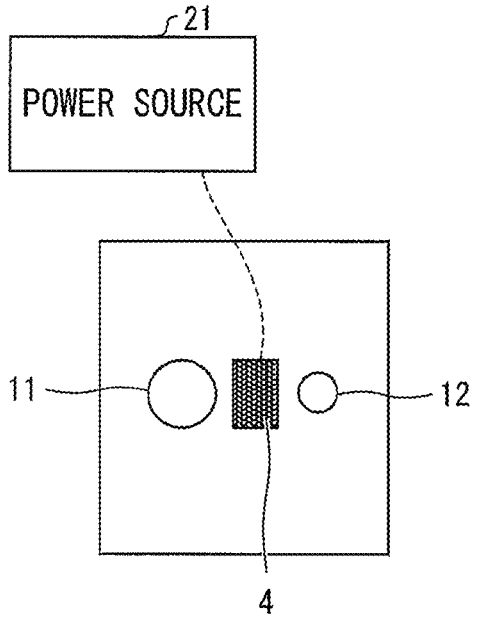
FIG. 21 is an elevation view illustrating an example arrangement of the guard electrode in the electrostatic atomizer in accordance with the present embodiment.

FIG. 21 is an elevation view illustrating an example arrangement of the guard electrode 4 in the electrostatic atomizer in accordance with the present embodiment. In the electrostatic atomizer in FIG. 21, the guard electrode 4 positioned between the spray electrode 1 and the reference electrode 2 has a rectangular parallelepiped shape. One plane of the guard electrode 4 is exposed on a surface of the electrostatic atomizer. The guard electrode 4 can be, for example, embedded in a groove on a surface of the electrostatic atomizer, or adhered to the surface of the electrostatic atomizer via an adhesive or the like. The guard electrode 4 having the rectangular parallelepiped shape is connected to a negative electrode of the power source 21. In a case where the guard electrode 4 is made of a conductive material, it can be determined appropriately which portion of the guard electrode 4 is to be connected to the power source 21.

Figure 22:
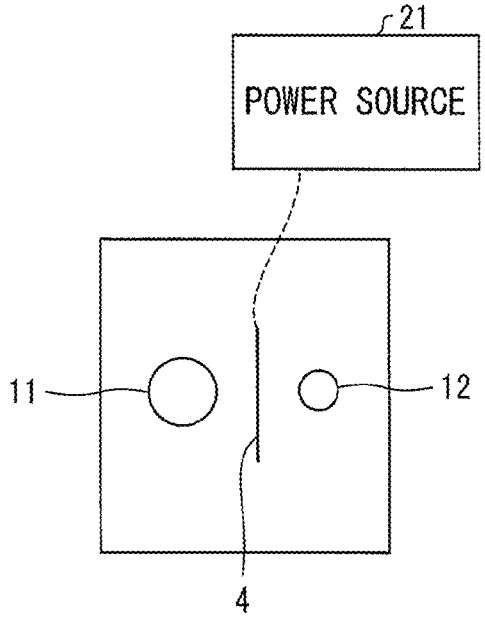
FIG. 22 is an elevation view illustrating an example arrangement of the guard electrode in the electrostatic atomizer in accordance with the present embodiment.

FIG. 22 is an elevation view illustrating an example arrangement of the guard electrode 4 in the electrostatic atomizer in accordance with the present embodiment. In the electrostatic atomizer in FIG. 22, the guard electrode 4 positioned between the spray electrode 1 and the reference electrode 2 has a needle shape. The guard electrode 4 can be, for example, embedded in a groove on a surface of the electrostatic atomizer, or adhered to the surface of the electrostatic atomizer via an adhesive or the like. One end of the guard electrode 4 is connected to a negative electrode of the power source 21.

The above has described various example arrangements of the guard electrode 4 with reference to FIGS. 18 through 22. The example arrangements described here are merely illustrative, and the present invention is not limited to these example arrangements. For example, the guard electrode 4 can have a spherical shape or a polygonal shape, instead of the needle shape or the rectangular parallelepiped shape. The guard electrode 4 can be electrically connected to the power source 21 in various ways.

[Supplemental Matters]

The electrostatic atomizer in accordance with one aspect of the present invention can be arranged such that the third electrode is provided between the first electrode and the second electrode.

With the arrangement, in the electrostatic atomizer in accordance with one aspect of the present invention, an electric field formed at the tip of the first electrode can be arranged to be more suitable for spraying a substance, so that spray stability can be further improved.

The electrostatic atomizer in accordance with one aspect of the present invention can further include a current control section for controlling a value of a current at the third electrode so that the value of the current is within a prescribed range.

Spray stability during a start-up period varies depending on a voltage applied between the first electrode or the second electrode and the third electrode.

Accordingly, a range of a value of a current at the third electrode which value leads to spray stability during the start-up period is figured out in advance, and the range is specified as a "prescribed range". Then, the current control section controls the value of the current at the third electrode so that the value can be within the prescribed range. Thus, the electrostatic atomizer in accordance with one aspect of the present invention can improve spray stability throughout an operation period including the start-up period.

The electrostatic atomizer in accordance with one aspect of the present invention can be arranged such that in a case where a voltage of 6 kV is applied between the first electrode and the second electrode, a voltage between the second electrode and the third electrode is controlled so as to be 2 kV or more and 2.4 kV or less.

The electrostatic atomizer in accordance with one aspect of the present invention can be arranged such that in a case where a voltage of 5.5 kV is applied between the first electrode and the second electrode, a voltage between the second electrode and the third electrode is controlled so as to be 1.9 kV or more and 2.3 kV or less.

The electrostatic atomizer in accordance with one aspect of the present invention can be arranged such that in a case where a voltage of 5 kV is applied between the first electrode and the second electrode, a voltage between the second electrode and the third electrode is controlled to be 1.8 kV or more and 2.2 kV or less.

With each of the above arrangements, the electrostatic atomizer in accordance with one aspect of the present invention can improve spray stability throughout an operation period including the start-up period.

The electrostatic atomizer in accordance with one aspect of the present invention can be arranged so as to further include a power source for applying a voltage between the first electrode and the second electrode, the third electrode being controlled so that no current flows through the third electrode.

With the arrangement, the electrostatic atomizer in accordance with one aspect of the present invention requires no flow of a current through the third electrode. Accordingly, the electrostatic atomizer can operate with no electric connection between the first electrode and the third electrode and between the second electrode and the third electrode. Consequently, the electrostatic atomizer in accordance with one aspect of the present invention is not required to have a power source for causing a current to flow through the third electrode, so that the electrostatic atomizer can be produced at low cost and a circuit design etc. of the electrostatic atomizer can be simplified.

The present invention is not limited to the embodiments, but can be altered by a skilled person in the art within the scope of the claims. An embodiment derived from a proper combination of technical means each disclosed in a different embodiment is also encompassed in the technical scope of the present invention.

INDUSTRIAL APPLICABILITY

The present invention can be suitably applied to an electrostatic atomizer that sprays aromatic oil, a chemical substance for an agricultural product, a medicine, an agricultural chemical, a pesticide, an air cleaning agent, or the like.

REFERENCE SIGNS LIST

1 spray electrode (first electrode)
2 reference electrode (second electrode)
3 power supply device
4. guard electrode (third electrode)
5 tip
6 spray electrode mounting section
7 reference electrode mounting section
8 negative electrode
9 inclined plane
10 dielectric
11 opening (first opening)
12 opening (second opening)
21, 21*a*, 21*b* power source
22 high voltage generator
23 monitoring circuit
24 control circuit
25 feedback information
100 electrostatic atomizer
221 oscillator
222 transformer
223 converter circuit
231 current feedback circuit
232 voltage feedback circuit
241 microprocessor

The invention claimed is:

1. An electrostatic atomizer comprising:

a first electrode which sprays a substance from a tip, the first electrode being provided inside a first opening formed at a surface of the electrostatic atomizer;

a second electrode being one of two electrodes between which a voltage is applied, the first electrode being another one of the two electrodes, the second electrode being provided inside a second opening formed at the surface of the electrostatic atomizer; and a third electrode being different from the first electrode and the second electrode and provided between the first opening and the second opening, the third electrode being one of two electrodes between which a voltage is applied, the first electrode or the second electrode being another one of the two electrodes, the voltage between the first electrode or the second electrode and the third electrode being controlled so as to have a magnitude within a prescribed range smaller than a magnitude of the voltage between the first electrode and the second electrode, wherein the first electrode inside the first opening and the second electrode inside the second opening are parallel with each other so as to be spaced apart from each other with a prescribed distance therebetween.

2. The electrostatic atomizer as set forth in claim 1, wherein the third electrode is provided between the first electrode and the second electrode.

3. The electrostatic atomizer as set forth in claim 1, further comprising a current control section for controlling a value of a current at the third electrode so that the value of the current is within a prescribed range.

4. The electrostatic atomizer as set forth in claim 1, wherein in a case where a voltage of 6 kV is applied between the first electrode and the second electrode, a voltage between the second electrode and the third electrode is controlled so as to be 2 kV or more and 2.4 kV or less.

5. The electrostatic atomizer as set forth in claim 1, wherein in a case where a voltage of 5.5 kV is applied between the first electrode and the second electrode, a voltage between the second electrode and the third electrode is controlled so as to be 1.9 kV or more and 2.3 kV or less.

6. The electrostatic atomizer as set forth in claim 1, wherein in a case where a voltage of 5 kV is applied between the first electrode and the second electrode, a voltage between the second electrode and the third electrode is controlled to be 1.8 kV or more and 2.2 kV or less.

7. The electrostatic atomizer as set forth in claim 1, further comprising a power source for applying a voltage between the first electrode and the second electrode, the third electrode being controlled so that no current flows through the third electrode.

8. The electrostatic atomizer as set forth in claim 1, wherein the first opening and second opening are configured so that when a voltage applied between the first electrode and the second electrode, an electric field is produced between the first opening and second opening and outside the electrostatic atomizer.

9. The electrostatic atomizer as set forth in claim 1, wherein the second electrode is a reference electrode.

* * * * *